United States Patent [19]

Ruben

[11] Patent Number: 4,578,950

[45] Date of Patent: Apr. 1, 1986

[54] DOUBLE-ACTING ROTARY MECHANISM FOR COMBUSTION ENGINES AND THE LIKE

[76] Inventor: Zorro Ruben, 1062 S. Avenida Conalea, Tucson, Ariz. 85748

[21] Appl. No.: 520,981

[22] Filed: Aug. 8, 1983

Related U.S. Application Data

[63] Continuation-in-part of Ser. No. 324,030, Nov. 23, 1981, Pat. No. 4,435,131.

[51] Int. Cl.[4] ..... F02G 1/04; F01B 9/00

[52] U.S. Cl. ..... 60/525; 60/517; 92/138

[58] Field of Search ..... 92/138; 417/334, 436; 416/77, 81; 60/517, 525, 721

[56] References Cited

U.S. PATENT DOCUMENTS

| | | | |
|---|---|---|---|
| 12,190 | 1/1855 | DeBergue | 417/436 X |
| 419,321 | 1/1890 | Courtright | 60/721 |
| 813,430 | 2/1906 | Hunter | 440/13 |
| 873,539 | 12/1907 | Guenther | 417/436 |
| 945,701 | 1/1910 | Courtright | 417/436 |
| 1,093,696 | 4/1914 | Guenther | 417/436 |
| 2,152,243 | 3/1939 | Daigor | 417/436 |
| 3,307,358 | 3/1967 | de la Roche Kerandraon | 60/221 |
| 3,599,401 | 8/1971 | Rich | 417/436 |

*Primary Examiner*—Stephen F. Husar

*Attorney, Agent, or Firm*—Russell E. Hattis; Daniel N. Christus

[57] ABSTRACT

An improved mechanism having a housing defining a gas pressure sustaining chamber for an engine, compressor, or the like, including a double-acting movable partition within the chamber providing alternate expansion and compression of the chamber's sections on opposite sides thereof. The movable partition comprises two rectangular plates in end-abutting relation having their adjacent ends pivotally mounted on a rotatable crank pin on which they undergo limited pivotal motion with respect to each other. The outer ends and sides of the partition plate make a sealing, sliding engagement with adjacent walls of the chamber and the outer ends are constrained to undergo reciprocating motion along substantially parallel lines.

9 Claims, 15 Drawing Figures

58
28
67
24
48
32
55
23
36
24
25
33
18
17
46
65
24
8
31
19
49
57
47
42
51
20
44
22
50
43
26
34
15

DOUBLE-ACTING ROTARY MECHANISM FOR COMBUSTION ENGINES AND THE LIKE

RELATED APPLICATION

This invention employs some of the features of the rotary mechanism disclosed and claimed in previously copending parent application Ser. No. 324,030, filed Nov. 23, 1981, which issued as U.S. Pat. No. 4,435,131 on Mar. 6, 1984. The present invention is a continuation-in-part of this parent application.

FIELD OF THE INVENTION

The present invention relates to a mechanism which produces rotary motive power from the expansion of high pressure gases and/or, conversely, compresses gases when rotated by an external power source. The most important commercial application of the invention is in engines such as those operating on Otto, Diesel, Stirling, or Brayton cycles. Presently, the most important application is in the four stroke cycle engine.

PRIOR ART AND SUMMARY OF THE INVENTION

It is a continuing objective, in the design of automobile engines and other mobile engines, to reduce the size and weight per horsepower output of the same. Perhaps the closest art, over which the present invention is a substantial improvement, is the Wankel-Froede rotary internal combustion engine. In that, and in other heretofore proposed rotary engines, a considerable portion of what might be otherwise useful chamber volume is occupied by a rotor body and/or mechanical core. The presence of this core detracts from their effective power output in proportion to size. In the present invention, the ratio of the actual displacement volume to the overall chamber volume has been substantially increased by its elimination of a central mechanical rotor and core in utilizing some of the features of the mechanism disclosed in U.S. Pat. No. 4,435,131. This results in a larger ratio of output power to overall engine size.

A movable partition within the chamber comprises two rectangular plates, hinged together, at their inner ends, for limited pivotal motion with each other, on an eccentric crankpin. At their outer ends, each plate supports pivotable slippers, slidably and sealably engaged in parallel oblique guide tracks. Each plate slides back and forth at its outer end while simultaneously rotating at its inner end. This motion results in expansion of the volume of the chamber's section on one side of the partition, during a half-revolution of the crankshaft, with coincident contraction of the volume of the section on the other side, followed by contraction of the volume on the first side with expansion on the other side during the subsequent half-revolution.

The crankpin is driven by a centrally located transverse mainshaft supported in bearings in longitudinal side walls of the chamber. An interior circular wheel crank disc, supporting the crankpin is recessed in each side wall. Also recessed in each side wall, but at each end of the chamber, are oblique (inclined) guide tracks for the slippers. These are parallel to each other and close to equally inclined and parallel inner end wall surfaces.

Three types of seals prevent pressure loss from side to side of the partition: thin annular washers cover the gap between the wheel crank discs and the openings in the side walls. Tranverse seals, at the plate's outer ends, contact the inclined end walls, and strip seals are placed in the partition plates' longitudinal side edges.

In this, as in the mechanism disclosed with the parent application, each fluid reactive partition plate—vane in the parent application—rotates at on end while reciprocating obliquely at its other end. In those embodiments disclosed in the parent application which have dual guide tracks, the tracks, although spaced apart, are shown as being substantially at right angles to each other. In the present invention these tracks differ significantly only in being parallel to each other.

In the parent application, the fluid reactive elements disclosed, therein referred to as "vanes", engage fluid moving in a longitudinal direction, whether through a duct or within a chamber. When the guide tracks are aligned parallel to each other, as in the present invention, the same "vane" elements, herein referred to as "partition plates", engage fluid moving in and out of the chamber transversely. Herein, the full chamber volume is discharged transversely, from one section of the chamber, by one side of the partition plates, while receiving fluid transversely on the other side, in one half-revolution. The full chamber volume is again discharged, this time from the other section, in the next half-revolution, while the first section fills.

The antecedant for the present invention's embodiment is stated at column 15, lines 11–25, of U.S. Pat. No. 4,435,131. This was not illustrated or claimed in the parent application.

Previous rotary mechanism engines, such as the aforementioned Wankel, present a problem in their separation, and concentration of hot and cold areas in the chamber walls. A cooling system must be provided which is capable of equalizing such temperature differentials to prevent uneven expansion and consequent warping of critical contacting surfaces. Fortunately, the present mechanism is almost completely free of this problem. In the Otto cycle embodiment of this invention, cool fuel-air mix enters each chamber, counteracting the subsequent heat of compression and combustion in the areas in which the heat is produced. Also, the walls of the full chamber are equally exposed for cooling-fluid contact, reducing the problem of maintaining equality of metal temperatures throughout.

A Wankel rotary engine also presents a problem in the supply of lubricant to the frictional contact surfaces of the apex seals to the extent that lubricant oil must wastefully be added to the fuel-air mix. In the present invention, lubrication is quite simply and expeditiously provided with a meterable, force-fed, supply line system to all frictional, load bearing, contact surfaces, quite similar to systems used in presently conventional engines.

Expansible chamber rotary engines present a particular problem in the prevention of power wasting "blow-by" of high pressure gas during the expansion (power) phase. The very simple but effective compression ring of conventional piston engines is indeed difficult to equal in rotary engines. The Wankel rotary engine must work with quite narrow, relatively sharp edged, apex seals. These are not only very difficult to lubricate effectively, but must operate at very high surface speed. The present mechanism meets a similar, but less demanding, situation at the outer ends of its partition plates which work against the interior of the chambers inclined end closure walls. Here, however, we find three ameliorating factors: First, the surface speed is considerably slower; second, the contacting end of this mechanism's seal can be provided with a substantial radius, approaching that of surface-to-surface contact; and third, the present mechanism allows the provision of a simple force-fed lubrication supply directly to the seal strip's contact surface.

Straight longitudinal pressure seals are provided on the side edges of this invention's partition plates. These seals are similar in operation to the curved seals on the sides of the Wankel engine's rotor. The operating conditions of these straight seals are considerably moderated by virtue of their much lower surface contact speed.

A third sealing area must be covered in the present mechanism that is not analagous in the Wankel engine but is quite simply met with the thin annular washer which effectively covers and seals the gap between the circular wheel crank disc and the adjoining longitudinal side walls of the engine chamber.

In an internal combustion engine, combustion efficiency requires a low ratio of wall surface area to chamber volume throughout the expansion plase. In the example of the Wankel rotary engine, the chamber clearance space varies from an initially elongated, string-bean-like shape, at full compression, to an eventual fat banana-like shape at full expansion. The present mechanism is somewhat better off in this respect. Within a few degrees of rotation from top center, the center of the partition drops away to open the chamber into a shape more representative of a cylindrical piston chamber. A further favorable condition for combustion efficiency is created by the rotation of the wheel crank disc around the central shaft. This helps to produce swirling turbulence which is a second requirement for efficient combustion. An additional favorable circumstance of the present mechanism is often referred to as "squish". At close to a top center position of the partition plates, the compressed volume being at the point of ignition, a small volume from each corner of the chamber is squeezed past narrow passages, at high velocity toward the center point of ignition. The resulting combination of swirl and squish is considered quite favorable in promoting complete combustion, with a consequent reduction of significant pollutants.

A further desirable objective is for economical manufacturing cost. Economy of fabrication is perhaps well exemplified in a further comparison with the Wankel engine, wherein the present invention, in its internal combustion mode, does away with a set of phasing gears. The simplicity of the mechanism of the parent application, in the present embodiment, indicates a substantial moderation of manufacturing costs.

In extending the above comparison, it may be noted that the Wankel engine does not require mechanical valves as does the present invention. However, the improved functional efficiencies of the present invention's poppet valves, over the slide valve function of the Wankel engine's ports, may be considered a better than even trade-off for the somewhat higher initial cost involved for valves.

While most of the features of the invention described herein have their greatest utility in engines wherein fuel enters into and is compressed and ignited within the chamber, many of these features are also advantageous when the mechanism is used as a compressor.

The above, and other features, objects and advantages will become apparent, and a fuller understanding of the invention described and claimed in the present application may be had, by referring to the following description and claims, taken in conjunction with the accompanying drawings.

DESCRIPTION AND OPERATION OF EXEMPLARY FORM OF THE INVENTION

Basic Form

Figure 1:
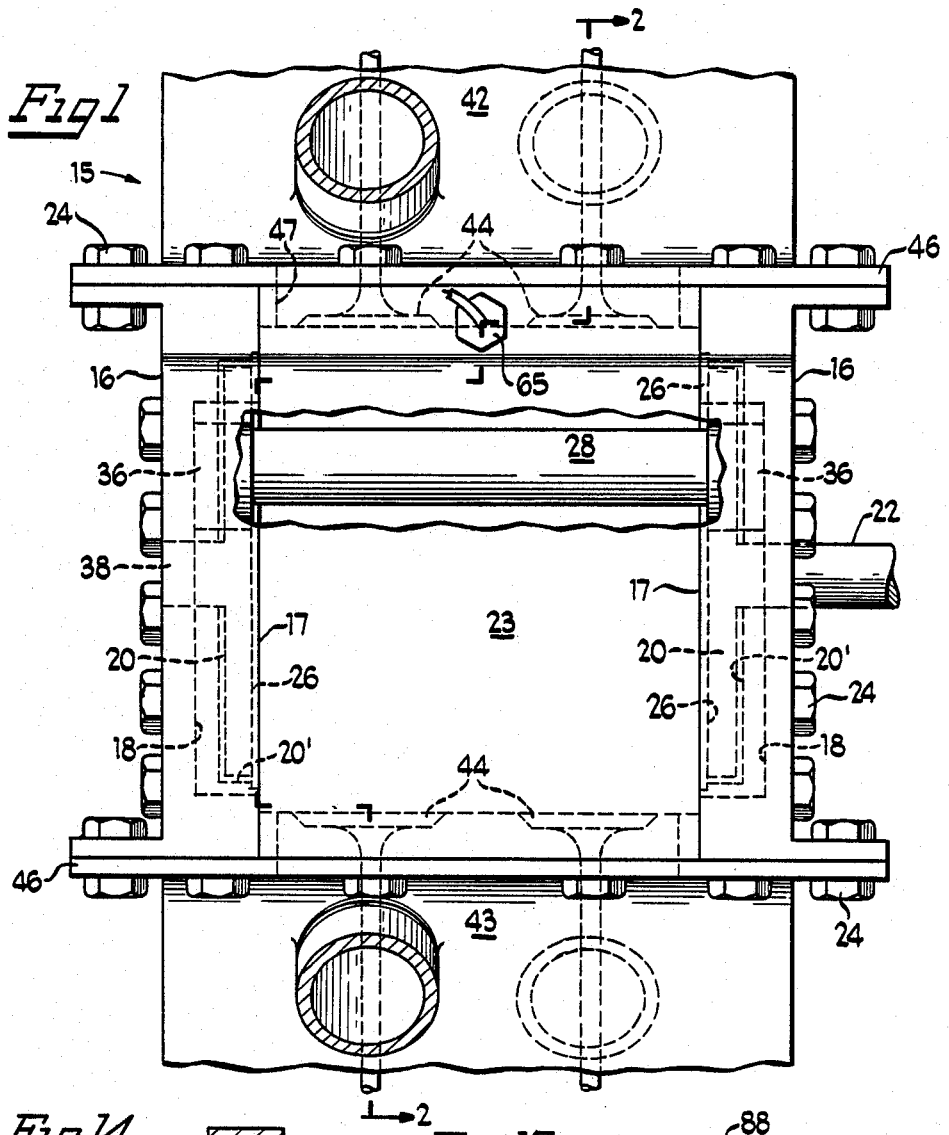
FIG. 1 is a right end transverse elevational view, partly broken away, showing a single chamber embodiment of this invention's mechanism, including fragmentary chamber heads and valves, as a four stroke cycle internal combustion engine.
Figure 2:
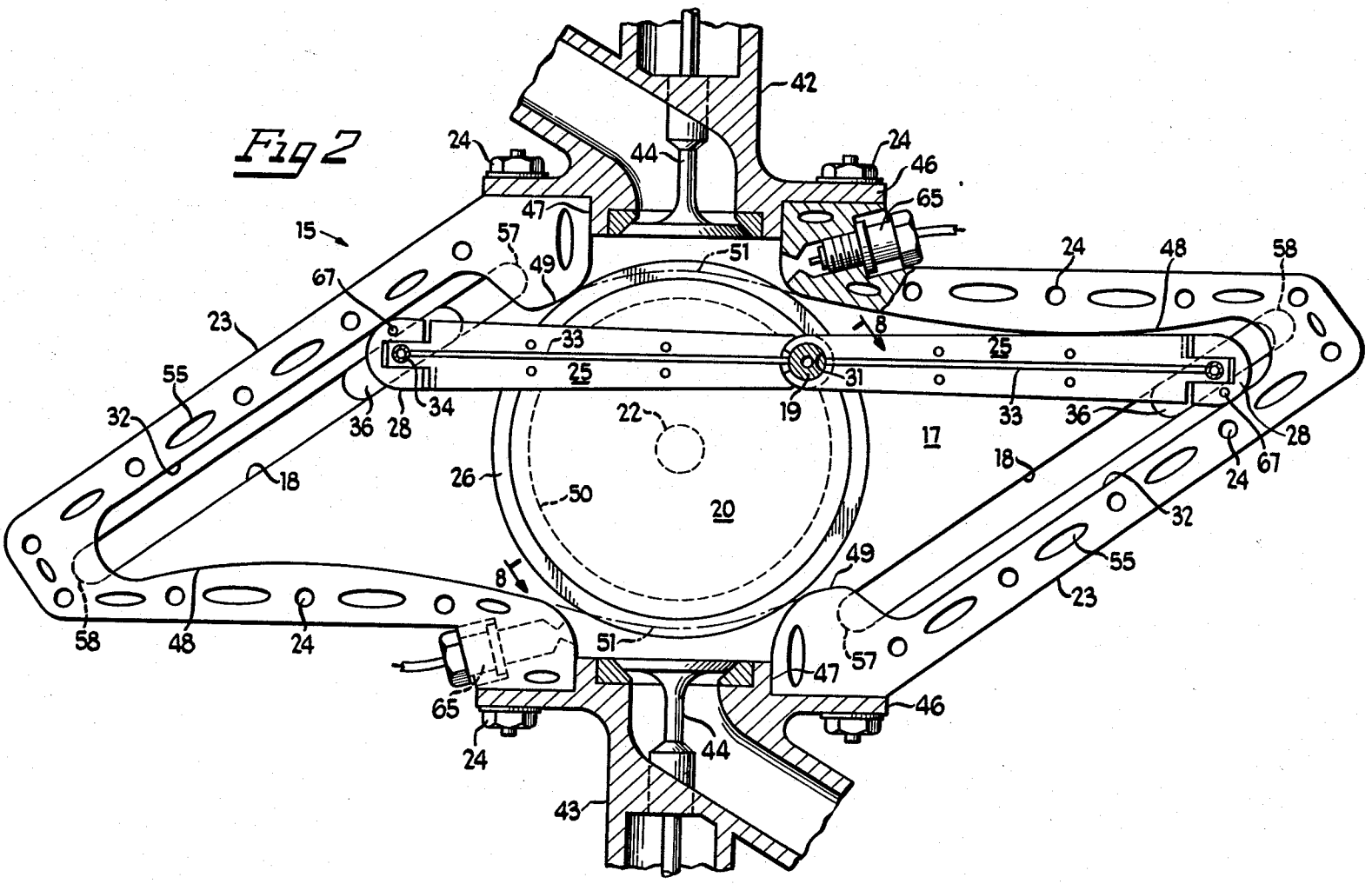
FIG. 2 is a longitudinal sectional view taken along the staggered line 2—2 of FIGS. 1 and 8, and is the clearest view of the rhombiform chamber and the partition plates of the present invention.

Referring to FIGS. 1 and 2, a single chamber embodiment of this invention, in the form of a four stroke cycle internal combustion engine mechanism is indicated generally by the numeral 15. The chamber is defined by a six wall member assembly.

Figure 3:
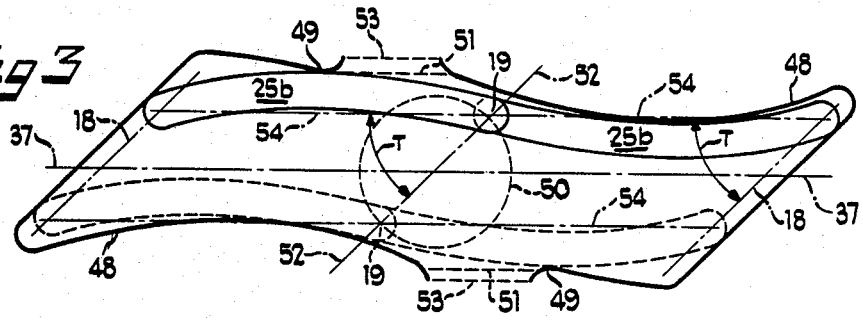
FIGS. 3 through 6 are kenematic diagrams showing progressing positions of a hypothetical chamber's curved partition plates.

Two wall members are the opposing and parallel longitudinal side walls 16. The two walls 16 are identical except for being mirror images. Four oblique or inclined guides 18 are placed in the interior facing sides 17 of the walls 16, near each end thereof. These guides are exactly positioned, two exactly opposite at each end and all parallel to each other. In this case, guides 18 are formed as straight line slots, grooved into the sides 17, at an acute angle, on the order of 45 degrees with an arbitrarily selected longitudinal axis 37, as indicated in FIG. 3. At the centers of walls 16, the interior facing sides 17 are each provided with exactingly opposed circular recesses 20', (FIG. 8) in the centers of which are closely clearing wheel crank discs 20. Each inner face, or cheek, of each wheel crank disc is effectively positioned axially within its recess so as to be flush with the interior face 17 of wall 16. A washer 40 (FIG. 8) is placed behind each wheel crank disc 20 to provide accurate axial spacing, to act as a final seal, and to sustain residual forces due to flexure of the crank cheek. One wheel crank disc is preferably formed integrally with a power output crankshaft 22, supported in a bearing 21 (FIG. 8) in one wall 16. A crankpin 19 is also preferably formed integrally with the wheel crank 20 and crankshaft 22.

The integrally formed crankshaft 22 may extend beyond the wall 16 to be connected to an automotive transmission, electrical generator or motor, pump, or the like, or to a second such engine mechanism's shaft as is the case in conventional multiple piston engines. Coincident with, or before or after assembly of the crankshaft and crankpin to the rear wall 16, two identical inclined end closure wall members 23 (FIGS. 1 and 2) are assembled to the rear wall 16 as with bolts or studs and nuts 24. Each member 23 is provided with a threaded opening into which an igniting (spark) plug 65 (FIG. 1) is placed. This is located in a suitable central position for initiating the combustion process and for access from the exterior. At the interior sides of the edges of the wheel crank periphery and the circular recess formed in the interior of the walls 16, a narrow and shallow recess 35, (FIG. 8) best formed for accuracy and high finish by grinding, is provided. Fitted to the exact depth and width of this shallow recess, and covering the narrow separation between the wheel crank disc's peripheral edge and the adjoining facing side 17, an annular washer 26 is placed to act as a seal against the escape of gas pressure, either to the exterior of the chamber or from one side to the other of a pair of juxtaposed partition-forming plates 25 which divide the chamber into two portions or sections. The washer 26 may have a light press fit on its shoulder on the wheel crank so as to rotate therewith.

Figure 10:
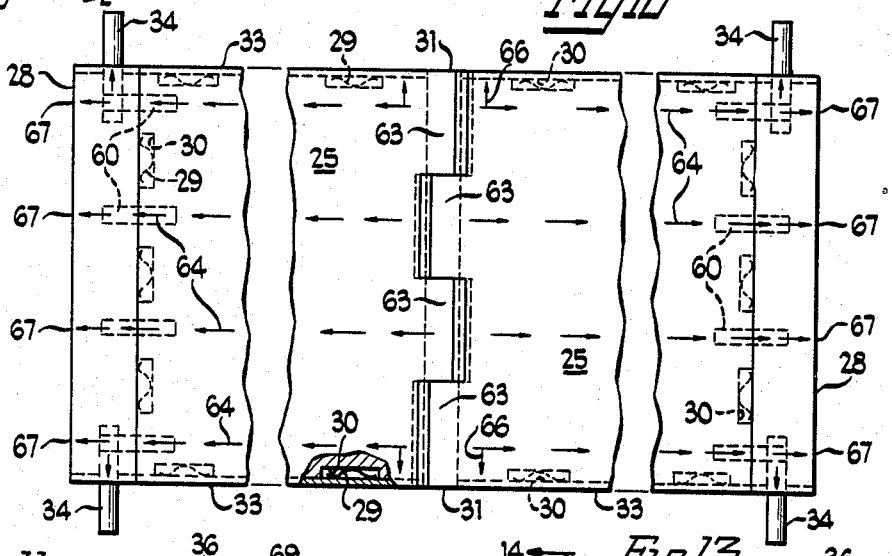
FIG. 10 is a plan view of the partition plates, the longitudinal view of which is shown in FIG. 2, showing, by means of dashed lines and short arrows, the paths and directions of lubricant supply lines, but omitting the crankpin on which the plates are articulated.

The partition plates 25, a longitudinal side view thereof being shown in FIG. 2, and a top or plan view in FIG. 10, are machined at their abutting inner, ends to form a very closely fitting hinge with a transverse bore 31. At their opposite or outer ends, the plates are also accurately machined with a transverse rectangular tongue 27 (FIG. 11) to which an equivalently grooved apex seal 28 is closely fitted. The apex seals, under pressure from leaf or ribbon springs 29, in recesses 30, (FIGS. 10 and 11) plus gas pressure within either chamber portion, slide back and forth while pressing against the inclined interior surfaces 32 of the end wall closure members 23. The wall surfaces 32 are machined accurately parallel to the oblique guides 18. The partition plates 25 are also provided with straight line, rectangular cross-section, seal strips and grooves 33 on their longitudinal side edges. These seal strips are also provided with the bent flat ribbon springs 29 in recesses 30. Gas pressure may be brought to bear behind the longitudinal springs by drilling a small hole, not shown, down into the recess 30, from the top or the bottom of each alternate recess so as not to allow leakage from one side to the other of the partition. Near each partition plate's outer end, two short, stud-like, axle-shafts 34 are pressed into blind bores, and each pivotably supports a slipper block 36, shown enlarged in FIGS. 11 through 14. The pivotable slipper blocks 36, which slide back and forth once with each revolution, are required to have very close fits within the slots 18 and to be accurately of the same depth as the slots.

After placing the rear annular seal 26 on the wheel crank that is integral with the crankshaft, the partition plates' hinge is assembled and the hinge bore is slipped over the cantilevered end of the crankpin 19. The front annular seal is placed on the interior peripheral recess 35 of the front wheel crank 20 which is integral with the short stub end 38 of the crankshaft. This assembly is then fitted in exact alignment with the opposite wheel crank by means of the male and female splines (FIGS. 8 and 9) on the crankpin and wheel crank respectively. A cross pin 41 is provided to withstand internal gas pressures and prevent relative axial movement of the splined wheel crank.

With the apex and longitudinal seals and springs, and the rear slipper blocks in place on the partition plates, the rear slippers may be aligned to the rear guide tracks, and the entire above mentioned assembly may be placed within the three chamber members and in contact with the interior of the rear wall 16. The front slippers can then be placed and aligned, and the front wall 16 can then be assembled to the chamber. At this point the chamber lacks only the top and bottom rectangular opening closures. These closure members are provided by two valve heads 42 and 43 (FIGS. 1 and 2), each of which contains at least one intake and one discharge valve. The valve heads may be of commonly known constructions for four stroke cycle conventional internal combustion engines containing, for example, the poppet valves 44, portions of which are shown less the springs which hold them in their closed position. At least two valves must be available to each chamber section, one inlet and one exhaust valve. Each pair of valves may be operated by a single camshaft, not shown, timed by gearing to the crankshaft. In the embodiment presented, the valve heads are provided with a flange 46 on four sides. The flange is bolted to the longitudinal walls 16 and to the end closures 23. A short shoulder 47 on the valve heads drops into the rectangular opening providing accurate spacing.

Figure 11:
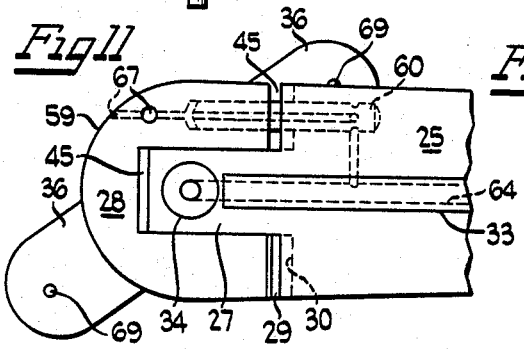
FIG. 11 is an enlarged fragmentary longitudinal side view of the outer end of a partition plate, showing details of the apex seal and a pivotable slipper behind it.
Figure 12:
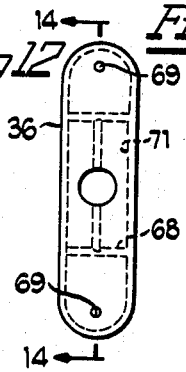
FIGS. 12 and 13 are enlarged longitudinal side, and end views, respectively, of a pivotable slipper.
Figure 13:
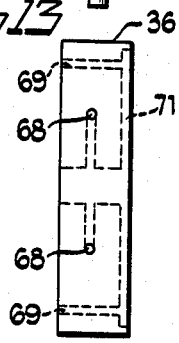

To provide passage for lubricant from a partition plate to an apex seal 28, and to assure accurate alignment for replacement as well as original apex seals, four hollow pins 60 (FIGS. 10 and 11) of precise diameter are pressed into place in bores in the partition plates located in line with (FIG. 10) but offset slightly (FIG. 11) from oil supply ducts 64. Oil may be fed to the pins 60 by way of crossover holes from ducts 64 and radial holes from the pins' center holes as shown in FIG. 11. Each blind cross-over hole, shown anywhere in the drawings, is drilled from the outside and the open end is plugged. Lined-up bores in the apex seals are closely but slidingly fitted over the pins 60.

It can be noted in FIG. 2, and diagrammatically in FIGS. 3 through 7, that one of the two identical end closures 23 is rotated 180 degrees about the centerline of the crankshaft 22 in its position with respect to the other. Thus, on the inner sides of closures 23 there are fairly lengthy surfaces 48 which are curved, on the order of a long radius of curvature, located diagonally opposite to each other, at the upper right and lower left. Also there are two shorter, and more sharply curved interior surfaces 49 similarly placed at the upper left and lower right. The surfaces 48 and 49 are so located that one or both are closely contiguous to, but distinctly clearing, the surfaces of the partition plates 25 during the substantial portion of each revolution when the plates approach them. The interior broken lines 51, connecting 48 and 49, indicate the outer limit of motion of the partition plates' hinge, beyond which valves may not move during the hinge's passing.

In FIGS. 2 and 3 the centerline of the crankpin 19 is at the specific position in which the longitudinal centerlines of the partition plates 25 are in alignment. This position occurs twice in each revolution at points on the circle where the radius 52, (FIG. 3) drawn through the crankshaft and crankpin centers, is parallel to the oblique guides 18. Note section line 8—8 on FIG. 2. These positions of the partition plates approximate those which would be called top and bottom dead centers in conventional crank and connecting rod piston engines and compressors. The spaces then remaining between the close side of the partition plates and the surfaces 48, 49 and 51 represent the approximately minimum clearance volumes.

It should also be noted that, in and near these positions, a small volume of gas appears to be trapped at the outer ends of each partition plate. This small volume of gas moves to the center area of the chamber through the narrow clearance space between the partition plates and the curved inner surfaces of the end closures 23. To prevent excessive velocity or pressure build-up, the clearance space may either be enlarged or narrow longitudinal grooves may be cut into the surfaces 48 and 49. However, this "squish" effect of the "trapped" gases rushing from the chamber ends to the center, where ignition starts, is a combustion aid which should effectively be retained.

Fluid Action and Kinematics (FIGS. 3 through 6)

An understanding of this mechanism's kinematics and fluid movement as presented in these four diagrams (FIGS. 3 through 6) will provide a basis for the selection of suitable part details and dimensions to meet the requirements of specific engine designs.

A hypothetical set of dimensional proportions of the mechanism parts is presented in the four diagrams. Each shows one of four progressive positions of the longitudinal edges of a pair of curved partition plates **25*b*, the hinged end of which moves along the broken line circle 50. The outer, slipper ends, of the plates move back and forth along the parallel, oblique, broken guide track lines 18. The outer solid lines represent the inner surfaces of the chamber. The broken lines 51 represent the inner positions of open poppet valves, while the broken lines 53** represent the closed position of the inside surface of the valves.

In the case of curved partition plates, such as **25*b* of FIGS. 3 through 7, their longitudinal centerlines 54 are considered to extend from the centerline of the slipper's axle shaft 34 to the centerline of the crankpin 19** in a straight line.

The motion of a partition plate is analagous to that of the conventional connecting rod link beetween a crankpin and a piston wrist pin. The kinematic difference in the analogy between the two lies in the direction and location of the line of reciprocation. The conventional connecting rod's reciprocation is directed toward and away from the center of rotation, substantially along a longitudinal axis passing through that center. Each partition plate's reciprocation is along an axis which lies considerably outside the circumscribed circle of revolution and is, moreover, oblique to the aforesaid longitudinal axis.

FIG. 3 may be produced by starting with assumptions for a center to center length P of partition plates **25*b*, a diameter D of the circular path of the crankpin 19, and an obliquity angle T of the guide track with the horizontal axis 37. As laid out in FIGS. 3 through 6, the ratio of D to P, the plate length along the line 54, is on the order of one-half, and the obliquity angle T is 45 degrees. The circular path 50 of the crankpin 19 is placed centrally. A radius 52 is then drawn through the center at the acute track obliquity angle T with the horizontal. From the intersection 19 of this oblique radius with the circular path 50, the plate length P is then laid out, on a single horizontal line, to the right and left of the intersection. At the distal ends of each plate, diagonal guide track lines 18** are drawn parallel to the radius at the 45 degree obliquity angle.

It is noted that, for every position of the partition plates with reference to the upper boundary of the chamber, a corresponding identical position obtains, at 180 degrees opposite, with reference to the lower boundary of the chamber. This is indicated in FIG. 3 by the partition plates drawn with broken lines through the crankpin 19 located at the opposite end of the radius 52.

To produce the inner boundaries 48, 49 and 51 of the chamber graphically, utilize a clear plastic template of the partition plate **25*b***. This may be moved incrementally around the crankpin circle at one end, and up and down the guide tracks at the other end, in its actual sequence of motion, while marking the outer limits of its working surfaces.

Figure 4:
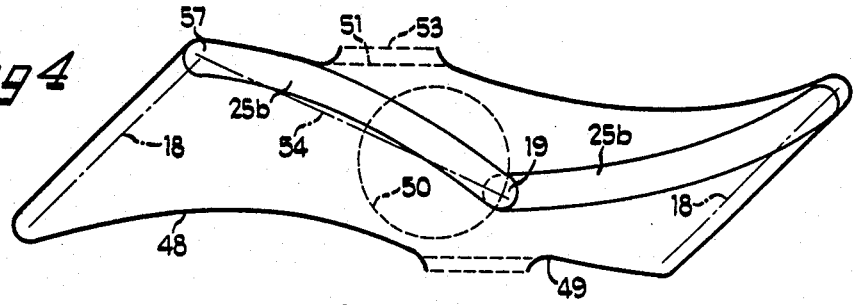

In FIG. 4 the crankpin 19 has moved clockwise, about one fifth of a revolution, from its position in FIG. 3, previously referred to as top center for the upper section of the chamber or bottom center for the bottom section. The left hand end of plate **25*b* is at its uppermost end point 57 on the close end of the guide track 18 when the plates centerline 54 crosses the center of the crankpin circle 50** as shown in the figure.

Figure 5:
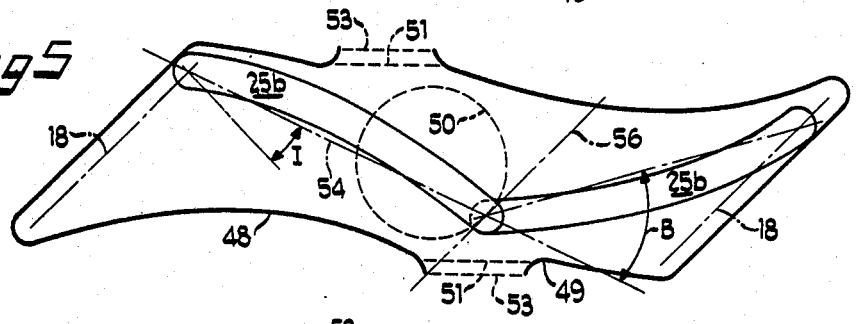

In FIG. 5 a line 56, parallel to the oblique guide line 18, is drawn tangent to the circle of rotation 50, establishing a point in this case one quarter of a revolution past the top center position of FIG. 3. In this position the left hand plate **25*b* is at its minimum angle of inclination from a vertical to the guide track 18. This angle I is here on the order of 20 degrees. I should not be reduced too drastically in any working model as reduction increases the stress on the axle shaft bearings 34 and pivotable slippers 36. This position also represents the maximum "bending" angle B of the hinge joint assembled on the crankpin 19**, here on the order of 43 degrees from its alignment position of FIG. 3. This angle is desirably kept small in working models.

Figure 6:
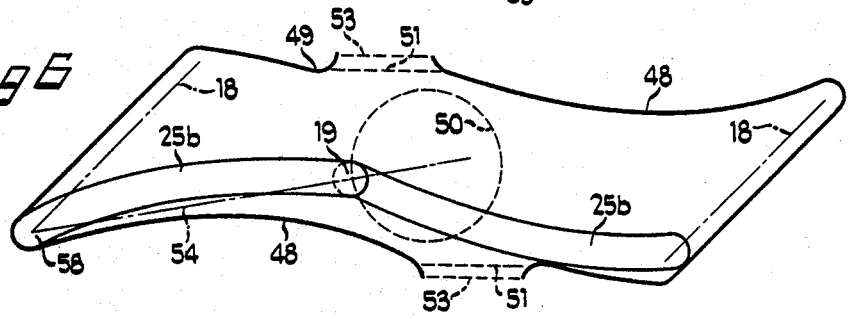

In FIG. 6 the crankpin 19 has moved to a position about three-fifths of a revolution from its position in FIG. 3. The extended centerline 54, of the left hand plate, here crosses the center of rotation, and the left end of the plate is at its lowermost position 58 on the far end of the guide track 18.

Further Considerations Concerning Mechanism Proportions

Figure 7:
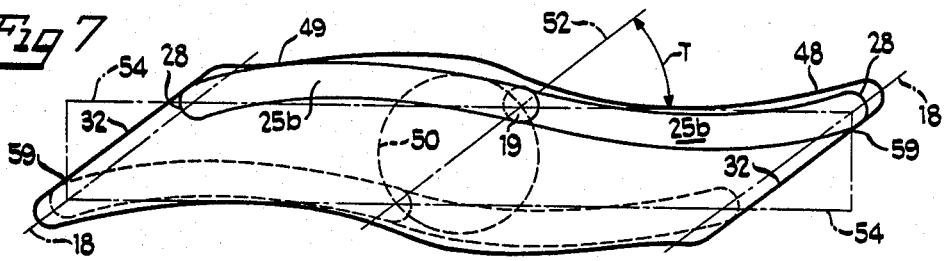
FIG. 7 is a diagram providing a comparision of compression ratio with FIG. 2.

One of the main considerations, other than displacement volume, in the selection of mechanism proportions is the resulting compression ratio. In FIG. 2, with flat partition plates, a D over P ratio on the order of three to four, and a guide track obliquity angle of 35 degrees, a compression ratio on the order of 7 to 1 is provided, sufficient for Otto Cycle engines. Higher compression ratios are provided, on the order of 10 to 1 with curved partition plates and the proportion of FIGS. 3 through 6. An increase in the track obliquity, such as the 37½ degree angle of FIG. 7, as compared with the 45 degrees of FIGS. 3 through 6, results in a compression ratio sufficient for Diesel Cycle combustion. A graphical method of approximating the compression ratio is indicated in FIG. 7. Here, the partition plates are shown in their bottom center position with broken lines, as well as in their top center position. The plates have their centerlines 54 extended, in each position, to terminate directly opposite the contact points 59 of the apex seals 28 with the diagonal end closure interior walls. The nominal area displaced is that of the rectangle shown in FIG. 7, less the area of the two end triangles exterior to the diagonal walls 32. The clearance area at top center between the partition plates' top surfaces and the interior curved walls 48 and 49 may be determined graphically, as with a planimeter. The area occupied by the space into which the valves open must be added to determine the complete clearance area and compression ratio.

It should be recognized that drastic sharpening of the guide track obliquity to obtain higher compression ratios can produce an unfavorably high ratio of surface area to displacement volume. Also in choosing suitable relative dimensions it should be realized that the partition plates may not be so short as to have the guide slot encroach too closely on the crank disc recess.

It is frequently desirable to utilize lighter density material for the partition plates than for the chamber walls. This usually involves greater heat expansion for the partition than for the chamber. The result would be bottoming of the slippers at the upper and lower ends of the guide slots. This can be avoided simply by increasing the length of the guide track slots, beyond that indicated in FIGS. 2 through 7, at least sufficiently to meet the conditions. This would, of course, also require somewhat extra clearance with the curved chamber walls 48 and 49. However, this would not reduce the compression ratio except very slightly and only momentarily at cold starting. Some temperature expansion is also provided for with the clearance spaces 45 (FIG. 11) provided between the apex seals and the partition plates.

Lubrication Systems (FIGS. 8 through 14)

Figure 8:
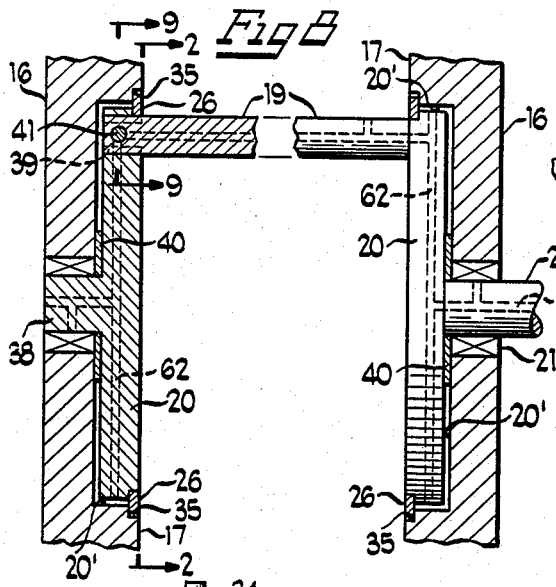
FIG. 8 is a fragmentary transverse view detailing the crankshaft, partly in a section taken along the line 8—8 of FIG. 2.
Figure 9:
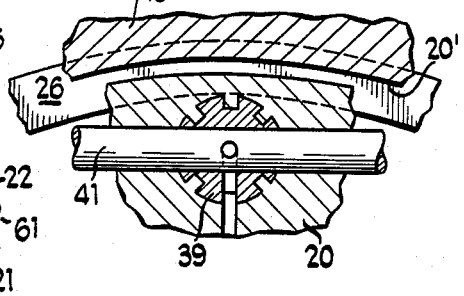
FIG. 9 is an enlarged fragmentary section, taken along the line 9—9 of FIG. 8, detailing the assembly of the two part crankshaft.

A distinguishing characteristic of the present mechanism is its enclosure within the chamber of the moving parts which are there subject to the maximum gaseous pressure and temperatures. These parts include the articulating hinge joint, longitudinal and apex seals and slipper blocks. In previous rotary engines apex seals were lubricated from an independent feed system, lubricant entering the intake port with the fuel-air mix. This sort of lubrication means could also be employed in the present mechanism. However, it would be wasteful of lubricant, inasmuch as a good part of the surface area within the chamber, namely the upper and lower curved chamber walls 48 and 49, and the upper and lower surfaces of the partition plates do not require lubrication. Moreover, this mechanism, in contrast with mechanisms of other rotary engines, permits the channeling of undiluted lubricating oil directly to all bearing surfaces through a central duct in the main shaft. Thus a pressure feed system can originate in a reservoir, not shown, in which an oil pump, operated by linkage to the power output shaft directs oil through the shaft header 61 (FIG. 8). Thence it can flow through a radially connecting passage to bearing 21, and, through radial openings 62, to the clearance space around the rear wheel crank disc 20 to lubricate the annulus seal 26. The oil supply header 61 continues through the crankpin 19 from which radial openings lead to the partition plates' hinge leaves 63 (FIG. 10). From the hinge, arrows 64 show the direction of oil flow in additional ducts not otherwise shown. These ducts may terminate in any number of points requiring lubrication. At 66 (FIG. 10) lubrication is provided for the longitudinal edge seals 33. At 67 (FIG. 11) lubrication is provided for the apex seals 28.

Figure 14:
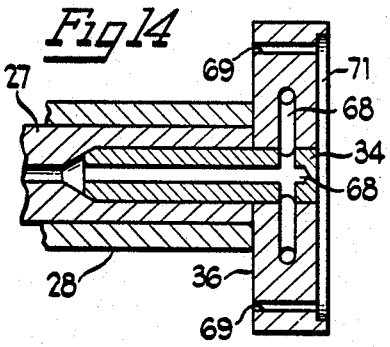
FIG. 14 is a sectional view, taken along the line 14—14 of FIG. 12, of a slipper block as it is assembled on a journal stud, detailing lubrication and gas pressure passages.

The four lines 64 indicate oil supplies to the apex seals 28. A very shallow, narrow lateral groove, not shown, can be cut, by grinding, along the contacting surface of each apex seal to interconnect the four oil outlets and permit the lubricant to spread out on the full area of contact. FIG. 14 indicates how lubricant, flowing through the centers of the axle shafts 34, which support the slippers 36, can be directed radially and cross-wise therefrom, through ducts 68, to lubricate their pressure contact surfaces. A gas pressure communication duct 69 leads to the undercut area 71 to hold the slipper's inside face against the partition plate's longitudinal edge.

The judicious employment, in additional areas, of similar gas pressure balancing can result in a reduced requirement for lubricating oil and, in some instances its complete elimination. Lubrication oil supply volume at particular points is controlled by sizing the opening at the end of each duct. A nonreturn (check) valve may be placed in the header supply line, just pass the outlet of the lubricant pump and, thereafter, a high pressure lubricant injection piston. Operated either off the power shaft or electronically, this piston may be timed to give very short bursts of lubricant before each compression stroke. Alternatively, two or more such pistons may supply lubrication directly, through side chamber walls 16, into the guide track surfaces, directly under the slipper edges, at optimum instants and intervals. The lubrication means suggested herein allows successive combustion strokes to consume successive short shots of oil. It thus obviates the need for recirculation to an oil sump, with consequent continuous deterioration of the lubricant supply, and the need for oil changes. However, should it be desired to circulate oil through the partition plates for cooling purposes, return lines may be located therein leading to return galleys in the crankpin and main shaft.

Cooling System

Coolant flow channels 55, shown as elliptical cored holes in the inclined outer end closure members 23 of FIG. 2 are connected to equal, lined-up holes, not shown, in the front and back longitudinal walls 16. Header holes may be cross-drilled so that circulation, and conventional radiators, may be employed for an effectively fluid cooling system. Otherwise, the same surface area may be finned, and air cooling then employed. In either event a very substantial area is available for cooling.

Balancing

I. Mass Acceleration Forces

Although not shown, this type of balancing is achieved in much the same way as in conventional piston engines by providing external balance weights on the crankshaft 22. In the present invention there is the added possibility of inserting heavier material in the wheel crank discs 20 opposite the crankpin 19. Also, similar to conventional engines, when two or more chambers are employed in a single engine, they may be placed on crankpins at angular offsets with each other to achieve substantial balance.

II. Internal Gas Pressure Forces

Observance of FIG. 8, in which the crankpin 19 is in its uppermost position, will disclose that internal gas pressure forces at this instant are directed substantially centrally and equally on each wheel crank cheek. Since the two wheel cranks 20 are tied to each other by the crankpin 19, the forces are in balance and there is no axial thrust load through washers 40 on bearings 21. However, as indicated in FIG. 2, as the crankpin progresses, the gas pressure in the axial direction will impinge eccentrically on the wheel crank cheeks. The resultant eccentric force, depending on the stiffness of the crank disc and its connections to the main shaft and crankpin, would cause flexure that could exert a residual force on the washer 40, transmittable to the bearing 21, unless the bearing is a tapered roller bearing capable of resisting this residual force.

Schematic Description of Second Form of the Invention

Figure 15:
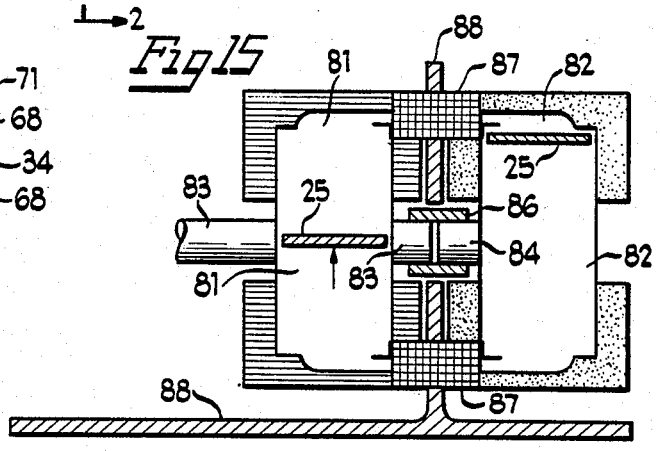
FIG. 15 is a simplified schematic diagram of working fluid flow illustrating the application of this invention to an engine employing externally applied heat, showing two chambers of the present invention in their application to a valveless Stirling engine.

A non-condensing, closed gas cycle, regenerative external combustion engine, generically referred to as a Stirling engine when the volume changes are effected without valves, is schematically diagrammed in FIG. 15. Two chambers, each enclosing mechanism such as disclosed herein, in FIGS. 1, 2, 3, and 7, but with ports instead of valves, are schematically represented at 81 and 82. The horizontal line shaded areas around chamber 81 represents a cooling system. The "loose sand" shading around 82 represents a heating system. Each chamber encloses, as part of the present mechanism invention, the double-acting positive displacement partition, shown diagrammatically at 25. Partitions 25 are actuated by independent shafts as follows: Shaft 83 for the cold chamber 81, and shaft 84 for the hot chamber 82. In the figure the shafts are lined up and tied together with a connecting ring 86. In the relative positions of the partitions as shown in FIG. 15, the hot space partition is moving ahead of, or leading, that of the cold space by 90 degrees of shaft rotation. The connection between the two shafts need not be fixed as shown. Instead of the locking ring 86, a phase relation speed control, such as shown in U.S. Pat. No. 3,315,465, may be interposed between the shafts. In that event, the two mechanisms will rotate, and operate satisfactorily, in opposite directions. Flow between the two chambers is directed through regenerators 87—symbolically shaded with "screen wire" lines. A support member 88 also serves to insulate the hot space from the cold space. An arrangement of double-acting pistons utilizing conventional crank and connecting rod or swash plate motion transference for the Stirling Cycle is old in the art. Further explanations of the pressure and volume changes are extensively available in current literature.

The arrangement available in this embodiment considerably surpasses those previously known mechanisms in its ratio of actual gas displacement volume to the overall external cubic dimensions and, consequently, in its ratio of power output to overall size and weight. A particular advantage of the present invention's double-acting partition in this Stirling engine embodiment is its minimizing of loss of working fluid, such as hydrogen or helium gas. Inevitable gas loss past the apex and longitudinal seals 28 and 33 merely passes into the working opposite section of the chamber and thus is not lost to ambient space. Such gas loss can only occur past the rotary annular seal 26, and that seal is backed up by the second washer seal 40.

Other Modifications and Applications

While the foregoing descriptions present specifics, there should not be construed as limitations on the scope of the invention, but rather as exemplification of preferred embodiments thereof. Other variations are possible and, since the present invention is essentially of a mechanism providing a double-acting expansible chamber, it may be applied wherever the conventional reciprocating cylindrical piston has been and may be applied. As an example, the mechanism may also be applied in the form of an external combustion or Brayton Cycle engine similar to that described in U.S. Pat. No. 3,577,729. Instead of the two single acting conventional cylindrical reciprocating pistons shown in the above patent, this invention's arrangement would incorporate two double-acting chambers in a similar manner to FIG. 15 for a Stirling Cycle engine. However, in the Brayton Cycle embodiment, conventional valving would be provided and an external combustion chamber, placed between the compression and expansion chambers, would supplant the regenerators and heat exchanger of the Stirling engine.

As a further example, the mechanism of this invention is not only applicable for continuous operation in one or the other rotational directions. It may also serve, where overall dimensions are desirably held to the very minimum, as a transducer of fluid to limited rotary motion, for up to one-half revolution, forward and back, where such rotary movement is required for control purposes.

Instead of detailing a crankshaft in two parts as done herein, each partition plate could be sandwiched, of an upper and lower half, although it might involve some extra complexity of the parts. Additional short lengths of longitudinal edge seal, connecting the apex seals and the partition plates, may be placed, off center of the main longitudinal seals. It should be understood that numerous modifications may be made in the preferred forms of the invention without deviating from its broader aspects. Accordingly, the scope of the invention should be determined not by the embodiments illustrated, but by the appended claims and their legal equivalents.

I claim:

1. In a mechanism having a housing defining a gas pressure sustaining chamber for an engine, compressor or the like, the improvement comprising partition-forming means within said chamber forming a double-acting movable partition providing alternate expansion and compression of the chamber sections on opposite sides thereof, said partition-forming means comprising two rectangular plates in end abutting relation having their adjacent ends pivotally mounted on a rotatable crankpin on which they undergo limited pivotal motion with respect to each other while rotating in a circle thereon, the outer ends and sides of said partition plates making sealing sliding engagement with adjacent walls of said chamber and said outer ends being constrained to undergo reciprocating motion along substantially parallel lines, said lines and extensions thereof lying outside of the crankpin circle.

2. The mechanism of claim 1 wherein the chamber is defined in part by parallel side walls and parallel inclined end walls, said crankpin is supported by wheel crank discs recessed within circular openings in said parallel side walls of said chamber and pressure sealing annular washers, fitted over the peripheries and recessed into the surfaces of the wheel crank discs and said circular openings close the gap between the discs and the parallel walls of said circular openings.

3. The gas pressure sustaining chamber of claim 1 wherein the chamber is defined in part by parallel side walls and parallel inclined end walls, the outer ends of said rectangular plates have transverse seals engaging said end walls, said seals have rectangular grooves closely and slidably fitted over matching tongues at said plates outer ends and have circularly curved transverse edges contacting said end walls.

4. A fluid power mechanism having a housing defining a pressure sustaining chamber rhombiform in longitudinal section and rectangular in transverse section, a transverse crank shaft connected to an interior crankpin, a movable partition within said chamber comprising two rectangular partition-forming plates in end abutting relation, hinged together at their inner ends for limited relative pivotal motion with respect to each other on said crankpin, the outer ends of said rectangular plates being guided to move in paths parallel to each other and oblique to the longitudinal axis of said chamber.

5. The mechanism of claim 1 or 4 wherein inlet and discharge valves are provided for said chamber on each side of said partition-forming plates and are operated by an auxiliary camshaft timed to effect a four stroke cycle internal combustion engine.

6. In a fluid energy machine including: (1) a rectangular fluid engaging plate having parallel side edges extending in a longitudinal direction, said edges being slidably fitted within an enclosure of rectangular cross section, (2) an end wall on said enclosure inclined to said longitudinal direction, (3) guidance means for one longitudinal end of said plate to constrain said longitudinal end to reciprocatory motion parallel to said inclined end wall, and (4) guidance means at said plate's opposite end to constrain last said end to coincident rotary motion, the improvement in sealing the contact of said reciprocatory end with said inclined end wall comprising a transverse seal having a rectangular transverse groove closely and slidable fitted over a matching tongue at said plate's reciprocatory end and a circularly curved transverse edge contacting said inclined end wall.

7. In a fluid energy machine including (1) a rectangular fluid engaging plate having parallel side edges extending in a longitudinal direction closely and slidably fitted between two parallel side walls, (2) guidance means for one longitudinal end of said plate constraining said end to reciprocatory motion along lines inclined to said longitudinal direction, (3) guidance means at said plate's opposite end, constraining last said end to rotary motion, comprising a crankpin supported by wheel crank discs recessed within circular openings in said parallel side walls, the improvement in pressure sealing the gap between said wheel crank discs and the circular openings in said side walls comprising annular washers fitted over the peripheries and recessed into the surfaces of the wheel crank discs and said circular openings.

8. Two adjacent mechanisms in tanden alignment with interconnected main shafts, each of said mechanisms having a housing defining a gas pressure sustaining chamber for an engine, compressor, or the like, the improvement comprising partition-forming means within said chamber forming a double-acting movable partition providing alternate expansion and compression of the chamber sections on opposite sides thereof, said partition-forming means comprising two rectangular plates in end-abutting relation having their adjacent ends pivotally mounted on a rotatable crank pin on which they undergo limited pivotal motion with respect to each other while rotating in a circle thereon, the outer ends and sides of said partition plates making sealing sliding engagement with adjacent walls of said chamber and said outer ends being constrained to undergo reciprocating motion along substantially parallel lines, said lines and extensions thereof lying outside of the crank pin circle, and wherein single ports are provided for each chamber, on opposite sides of each pair of partition-forming plates, said ports of each mechanism being ducted to the ports of the other mechanism, cooling means for one said mechanism and heating means for the other to effect a Stirling cycle heat engine.

9. Two adjacent fluid power mechanisms in tandem alignment with interconnected main shafts, each of said fluid power mechanisms having a housing defining a pressure sustaining chamber rhombiform in longitudinal section and rectangular in transverse section, a transverse crank shaft connected to an interior crank pin, a movable partition within said chamber comprising two rectangular partition-forming plates in end-abutting relation, hinged together at their inner ends for limited relative pivotal motion with respect to each other on said crank pin, the outer ends of said rectangular plates being guided to move in paths parallel to each other and oblique to the longitudinal axis of said chamber, wherein single ports are provided for each chamber, on opposite sides of each pair of partition-forming plates, said ports of each mechanism being ducted to the other ports of the other mechanism, cooling means for one said mechanism and heating means for the other to effect a Stirling cycle heat engine.

* * * * *